US009828147B2

(12) United States Patent
Escudero Prior

(10) Patent No.: US 9,828,147 B2
(45) Date of Patent: Nov. 28, 2017

(54) DECANTER STOPPER

(71) Applicant: Joaquin Escudero Prior, San Sebastian (ES)

(72) Inventor: Joaquin Escudero Prior, San Sebastian (ES)

( * ) Notice: Subject to any disclaimer, the term of this patent is extended or adjusted under 35 U.S.C. 154(b) by 11 days.

(21) Appl. No.: 15/007,506

(22) Filed: Jan. 27, 2016

(65) Prior Publication Data

US 2017/0021981 A1 Jan. 26, 2017

(30) Foreign Application Priority Data

Feb. 2, 2015 (ES) ..... 1138833 U

(51) Int. Cl.
*B65D 47/04* (2006.01)
*B65D 39/00* (2006.01)

(52) U.S. Cl.
CPC ..... *B65D 47/043* (2013.01); *B65D 39/0052* (2013.01)

(58) Field of Classification Search
CPC ..... B65D 47/043; B65D 39/0052
USPC ..... 215/355, 364; 222/190; 261/76; 220/801
See application file for complete search history.

(56) References Cited

U.S. PATENT DOCUMENTS 1,436,645 A * 11/1922 Brown ..... B65D 47/18 215/309
2007/0187848 A1* 8/2007 Sabadicci ..... B01F 5/0413 261/76
2008/0308576 A1* 12/2008 Presa Aguero ..... A47G 19/12 222/154
2010/0091605 A1* 4/2010 Rasmussen ..... B01F 3/0446 366/107
2012/0056339 A1* 3/2012 Chiorazzi ..... B01F 3/0446 261/76
2012/0074092 A1* 3/2012 Devoy ..... B01F 3/0446 215/40
2012/0261844 A1* 10/2012 Lei ..... B01F 3/04751 261/119.1
2014/0252662 A1* 9/2014 Graham ..... B01F 5/0428 261/76
2016/0030898 A1* 2/2016 Devoy ..... B65D 1/02 215/40

* cited by examiner

*Primary Examiner* — James N Smalley
(74) *Attorney, Agent, or Firm* — Mark Levy; Hinman, Howard & Kattell, LLP

(57) ABSTRACT

A decanter stopper having a hollow, main cylinder body. A protuberance in the form of a notched H-shaped insert extends from the proximal end of the main cylinder body. Curved side walls are disposed at each opposing end of the H-shaped insert. Two channels are formed in the insert between the curved side walls.

4 Claims, 2 Drawing Sheets

DECANTER STOPPER

OBJECT OF THE INVENTION

This invention, according to the description, refers to a decanter-stopper device, which through the morphological improvements described herein allows for the concentration of the dispensed liquid so as to allow the consumer to increase the flow and accuracy of pouring from the bottle to the receiving liquid container, while minimizing the risk of spilling the poured liquid and is also designed to be the original bottle stopper.

BACKGROUND OF THE INVENTION

There are many drinks that are poured directly from the bottle. The pouring can be handled with or without a decanter to enjoy the drink at its most optimum condition. For the first option, this requires a skill and practice that not everyone has. For the second option, there are different tools in the market that allow consumers a correct pour to fully enjoy the drink. When both options are not available, the result can be losing liquid during pouring and not enjoying the liquid in its optimum state.

The flow of pour, as well as its accuracy, play a specific part in what is considered to be a proper pour.

On the other hand, according to the material used to manufacture the stopper, and more specifically synthetic injection stoppers, the point of injection may alter the longitudinal measurements which are vital in the orientation process of the stopper during bottling.

DESCRIPTION OF THE INVENTION

This invention resolves the problems described above, equipping the stopper with a novel morphology in its pouring section and at the same time has a space at the point of injection so that the irregularities produced by such injection do not alter the final length of the stopper which is key in the orientation process prior to its bottling.

The stopper is divided into two parts, one is dedicated to the pouring and the other is intended for the original capping of the bottle.

The pouring section is made up of two opposed channels that can be used interchangeably for the air to enter the bottle and for the liquid to be poured from the bottle.

At the intersection of the section intended for pouring and the stopper and flanking both channels, there are two round segments with a double function. On the one hand they close the pouring exit holes laterally to avoid its dispersion and on the other hand its longitudinal width with respect to the stopper shall determine the optimum point of pouring of the invention presented.

The part intended to stopper the bottle is the remaining part of the stopper which is completely cylinder.

With all of the above, once the bottle is open (uncork), the stopper itself can be used as a decanter.

DESCRIPTION OF DRAWINGS

To complete the description to be made and with the purpose of aiding in a better understanding of the specifications of the invention, according to a preferred example of its making, a set of drawings is attached to this description which includes but is not limited to showing the following.

PREFERRED EMBODIMENTS OF THE INVENTION

Figure 1:
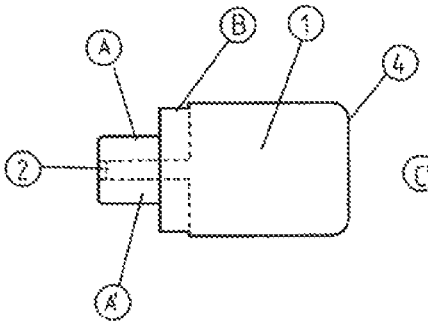
FIG. 1 shows a side view of the stopper.
Figure 2:
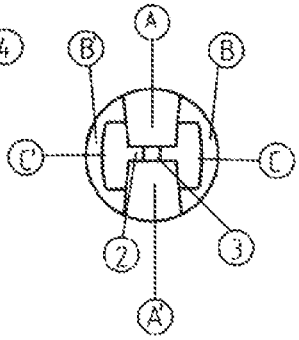
FIG. 2 shows a front view of the end of the pouring section mentioned in the invention.
Figure 3:
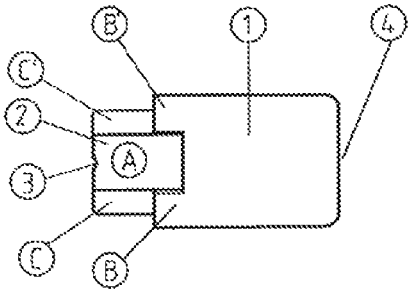
FIG. 3 shows a bottom view of the pouring stopper mentioned in the invention.
Figure 4:
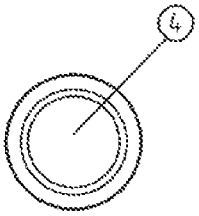
FIG. 4 shows a front view of the end of the part used as the stopper.
Figure 5:
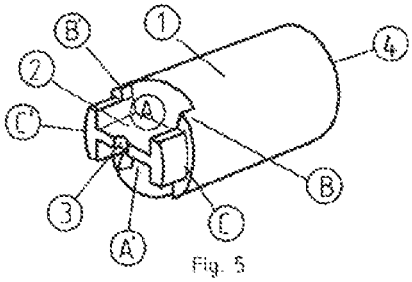
FIG. 5 shows a perspective of the stopper view from the pouring section.

As seen in the indicated figures and specifically in FIGS. 1, 2, 3, 4 and 5, this shows how the decanter-stopper proposed in the invention is constructed from a one-piece body made of flexible material. The device is constructed on a cylinder base (1) with two well-differentiated parts, on the one hand the cylinder base 1 and the end 4 are intended to serve the function of a conventional stopper for the original seal of the bottle (FIG. 6), and on the other hand the end which has, among others, channels A and A' which shall perform the function of decanter once the bottle is opened and such end is partially re-inserted in the neck of the bottle.

At the end that matches with the pouring part of the stopper and with the purpose of achieving such function it has two opposed channels, A and A', the making o such channels is the result of lateral walls C and C' and the central platform that joins them both (2), therefore creating what would be called a type of "H" where its spaces would be the previously mentioned channels and would indistinctly have the mission of allowing air to enter or for liquid to be poured.

The outside of side walls C and C' shall have a slight curve with the purpose of allowing that at the moment of inserting the pouring end into the opening of the bottle it would allow a better adaptation into the interior walls of such neck in order to facilitate the insertion of the decanter part into the neck of the bottle, the diameter that spaces the curves of the external walls C and C' shall be slightly greater than the diameter of the neck of the bottle and smaller than the diameter that separates the round segments B and B' which shall be mentioned below.

Both round segments (B and B') are at the intersection between walls C and C' and the cylinder base of the stopper with two clearly different missions; on the one hand the result of the difference exists between walls C and C' and round segments B and B' which gives way to four "peaks" that flank the output of the liquid from the decanter with the mission of avoiding the spilling of the poured liquid and to achieve its best concentration during the handling of the pouring. On the other hand the difference of the concentric diameters from C, C' and B, B' shall create both steps which shall act as a cap when inserting the pouring end into the neck of the bottle determining what is considered to be the optimum pouring position (FIGS. 6 and 7).

To obtain an easy penetration as well as a good hold of the pouring end in the inside walls of the neck of the bottle, it is necessary that the concentric diameter the existing distance between the external faces and external walls of C and C' is a lower concentric diameter than the main cylinder body.

Likewise, and on the external side of platform 2 there is a space (3) with the purpose of ensuring that the resulting peak from the point of injection of the stopper during manufacturing does not affect the length of the stopper which is key in the direction of the stopper during the bottling process.

Figure 6:
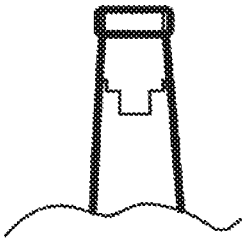
FIG. 6 shows a diagram representation showing the decanter-stopper proposed by the invention, as the original bottle stopper.
Figure 7:
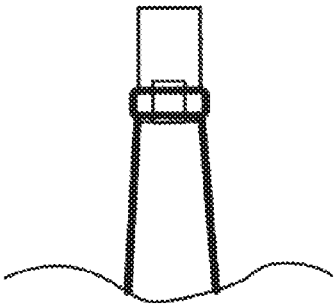
FIG. 7 shows a diagram representation showing the decanter-stopper proposed by the invention, as a decanter.

FIG. 6 shows the original bottle stopper.

FIG. 7 shows the available stopper ready to serve as a decanter.

Figure 8:
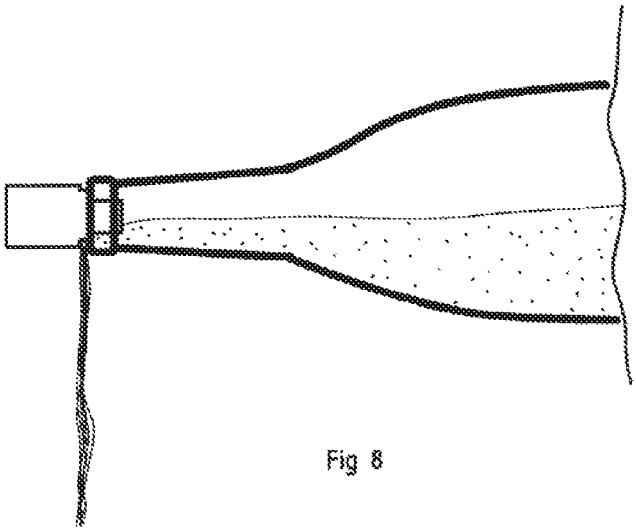
FIG. 8 shows a diagram representation showing the decanter-stopper proposed by the invention used to pour.

FIG. 8 shows the stopper during pouring.

The invention claimed is:

1. A decanter-stopper comprising:

a) a hollow, main, right cylinder body having an axis of rotation along a horizontal direction and a predetermined diameter and a proximal end and a distal end and having a protuberance extending from the proximal end thereof, said protuberance comprising an H-shaped insert having two opposing ends and a horizontal, longitudinal, joining element parallel to said axis of rotation, said longitudinal, joining element having a notch formed therein, and said longitudinal, joining element further comprising two curved side walls each having an external surface, said side walls being disposed, respectively, at each of said opposing ends of said H-shaped insert, and said side walls being offset from said hollow, main cylinder body; and b) two channels formed between said curved side walls above and below said horizontal, longitudinal joining element, respectively.

2. The decanter-stopper in accordance with claim 1, wherein said protuberance is centrally disposed with respect to said hollow, main cylinder body.

3. The decanter-stopper in accordance with claim 2, wherein the distance between the external respective surfaces of said curved side walls is less than said diameter of said main cylinder body.

4. The decanter-stopper in accordance with claim 2, manufactured with flexible material.

* * * * *